United States Patent [19]

Osborn et al.

[11] Patent Number: 4,801,339

[45] Date of Patent: Jan. 31, 1989

[54] PRODUCTION OF AL ALLOYS WITH IMPROVED PROPERTIES

[75] Inventors: Donald H. Osborn; Paul S. Gilman, both of Suffern; Stephen J. Donachie, New Windsor, all of N.Y.

[73] Assignee: Inco Alloys International, Inc., Huntington, W. Va.

[21] Appl. No.: 712,701

[22] Filed: Mar. 15, 1985

[51] Int. Cl.[4] ..... C22F 1/04

[52] U.S. Cl. ..... 148/11.5 A; 148/11.5 P; 148/12.7 A; 148/415; 148/437

[58] Field of Search ..... 148/11.5 A, 11.5 P, 148/12.7 A, 415–417, 437–440

[56] References Cited

U.S. PATENT DOCUMENTS

| | | | |
|---|---|---|---|
| 3,591,362 | 7/1971 | Benjamin | 75/5 BA |
| 3,740,210 | 6/1973 | Bomford et al. | 75/5 AC |
| 3,816,080 | 6/1974 | Bomford et al. | 29/182.5 |
| 4,292,079 | 9/1981 | Pickens et al. | 75/232 |
| 4,297,136 | 10/1981 | Pickens et al. | 75/206 |
| 4,409,038 | 10/1983 | Weber | 148/12.7 A |
| 4,532,106 | 7/1985 | Pickens | 420/19 |

OTHER PUBLICATIONS

Metals Handbook, 8th Ed., vol. 5 (1970), pp. 127–132.

H. K. Hardy, "Trace-Element Effects in Some Precipitation-Hardening Aluminum Alloys", in Journal of the Inst. of Metals, vol. 84, pp. 429–439, 1955–1956.

L. P. Costas and R. P. Marshall, "The Solubility of Lithium in Aluminum", Trans. of the Met. Soc. of AIME, vol. 224, pp. 970–974, Oct. 1962.

Rare Metals Handbook, 2nd Ed., pp. 249–263, 1967.

G. E. Thompson and B. Noble, "Precipitation Characteristics of Aluminum-Lithium Alloys Containing Magnesium", Jnl. of the Inst. of Metals, vol. 101, pp. 111–115, 1973.

T. H. Sanders and E. S. Balmuth, "Aluminum-Lithium Alloys: Low Density", Metal Progress, pp. 32–37, Mar. 1978.

Charles T. Post, "New Aluminum Alloys Ready to Muscle in on Titanium", Iron Age, pp. 41–43, Jul. 3, 1978.

Craig Covault, "Aluminum Study Funds Sought", Aviation Week & Space Tech., pp. 14–15, Jul. 31, 1978.

Chem. Abst., vol. 66, 78565v, (1967).

Z. A. Sviderskaya and V. I. Kuz'mina, "Properties of Al-Li Alloys", Soviet J. Non-Ferrous Metals, vol. 9, #2, pp. 115–188, Feb. 1968.

I. N. Fridlyander et al., "New Light Alloys of Aluminum with Lithium and Magnesium", Nonferrous Metals and Alloys, pp. 211–212, Mar. 1968.

B. Noble and G. E. Thompson, "Precipitation Characteristics of Aluminum-Lithium Alloys", Metal Science Journal, vol. 5, pp. 114–120, 1971.

*Primary Examiner*—R. Dean

*Attorney, Agent, or Firm*—Raymond J. Kenny; Francis J. Mulligan, Jr.

[57] ABSTRACT

A process for improving the properties of low density aluminum alloys comprises a controlled heat and cooling treatment of a shaped alloy to obtain a product which in the non-aged condition has improved fracture toughness without sacrificing tensile properties. The product is particularly useful for treating forged Al-Li-Mg alloys.

25 Claims, 1 Drawing Sheet

PRODUCTION OF AL ALLOYS WITH IMPROVED PROPERTIES

FIELD OF THE INVENTION

This invention relates to aluminum-lithium alloys. More particularly it pertains to a method of improving fracture toughness in the non-aged condition without sacrificing tensile properties of articles prepared from aluminum-lithium alloys.

BACKGROUND OF THE INVENTION

Notwithstanding the significant advances which have been made over the years in respect of materials capable of delivering improved metallurgical properties, considerable research efforts continue in the search for new alloys to satisfy the demands of advanced design in the aircraft, automotive and electrical industries. While high strength is a key characteristic of the materials sught, to meet the qualifications for certain advanced design applications, the alloys must meet a combination of property requirements such as density, ductility, fracture toughness, corrosion resistance as well as strength, depending on the ultimate end use of the materials.

Aluminum-lithium alloys are potential candidates for many applications when low density and high elastic modulus are important. The present invention applies to aluminum-lithium alloys containing a dispersoid constituent, as will be described more fully below.

Heretofore, many aluminum-lithium alloy systems made by ingot and powder metallurgy routes have been studied. Efforts have been made to strengthen the systems by incorporating additives in the alloy to cause or increase precipitation hardening or to distribute a dispersoid in the alloy. While effective, there are limits to the amount of strengthening agents that can be added without sacrificing other properties such as ductility, fracture toughness and corrosion resistance. Certain alloys can be aged to increase strength. However, even in the aged condition, the alloys can not meet the desired combination of target properties specified.

The complexity of the problem goes far beyond the difficulties of developing materials with suitable combinations of properties not achieved before. Economics also plays a large role in the choice of materials. The ultimate product forms are often complex shapes, and the potential savings resulting from possible composition substitution is only a part of the picture. The new aluminum alloys would be particularly valuable if they could be shaped into desired forms using cost effective techniques such as forging while retaining their preshaped properties and/or if they could be fabricated economically into the same complex shapes now used with other materials so as to eliminate the need for retooling for fabrication of weight saving structures. Moreover, to be commercially useful, the fabricated parts must have reproducible properties. From a vantage point of commercial viability, the reproducibility will be attainable under a practical range of conditions.

The present invention is not confined to any one route known in the art for producing the alloy products. It can be incorporated into the process subsequent to the shaping steps, as will be further described below. However, it is particularly useful further when incorporated into a powder metallurgy route, and it is especially useful in the preparation of aluminum-lithium alloys from mechanically alloyed powder.

The use of powder metallurgy routes to produce high strength aluminum has been proposed and has been the subject of considerable research. Powder metallurgy techniques generally offer a way to produce homogenous materials, to control chemical composition and to incorporate dispersion strengthening particles into the alloy. Also, difficult-to-handle alloying elements can at times be more easily introduced by powder metallurgy than ingot melt techniques. The preparation of dispersion strengthened powders having improved properties by a powder metallurgy technique known as mechanical alloying has been disclosed, e.g., in U.S. Pat. No. 3,591,362 (incorporated herein by reference). Mechanically alloyed aluminum-base alloys are characterized by fine grain structure which is stabilized by uniformly distributed dispersoid particles such as oxides and/or carbides. U.S. Pat. Nos. 3,740,210 and 3,816,080 (incorporated herein by reference) pertain particularly to the preparation of mechanically alloyed dispersion strengthened aluminum. Other aspects of mechanically alloyed aluminum-base alloys have been disclosed in U.S. Pat. Nos. 4,292,079, 4,297,136 and 4,409,038.

It is academic that composition of an alloy often dictates the fabrication techniques that can be used to manufacture a particular product. In general, the target properties which must be attained in the type aluminum alloys of this invention before other properties will be considered are strength, density and ductility. One of the marked advantages of dispersion strengthened mechanically alloyed powders is that they can be made into materials having the same strength and ductility as materials made of similar compositions made by other routes, but with a lower level of dispersoid. This enables the production of alloys which can be fabricated more easily without resorting to age hardening additives. While the mechanical alloying route produces materials that are easier to fabricate than other aluminum alloys of comparable composition, the demands for strength and low density and the additives used to obtain higher strength and/or lower density usually decrease workability of the alloy system. (Workability takes into account at least ductility at the working temperature and the load necessary to form the material.) The extent of the effect is generally related to the level of additive in the alloy. The additives not only affect the method by which the material can be fabricated, but also the fabrication techniques affect the properties of the materials.

For most uses a powder must be fabricated into a final product, e.g., by degassing, compaction, consolidation and shaping in one or more steps. To obtain complex parts the fabrication may take the form, e.g., of extruding, forging and machining. Usually, the less machining required to make a part the greater the economy in material use, labor and time. It will be appreciated that it is an advantage to be able to make a complex shape by forging rather than by a route which requires the shaping by manual labor on an individual basis.

U.S. patent application No. 664,058, filed Oct. 23, 1984, discloses a method for producing low density, dispersion strengthened aluminum-lithium alloys into forged parts characterized by improved strength by shaping, i.e. extruding and forging, the alloys under certain conditions. The disclosed method to produce forged parts carries with it the advantages of using a powder metallurgy route, mechanical alloying and forging, as explained above. The present invention will be illustrated below mainly with reference to the method of such application, which is incorporated herein by reference.

It was unexpected that heat treatment for improving fracture toughness could be carried out without reducing tensile properties in the non-aged condition. It was particularly surprising that forged material is amenable to such treatment because the temperatures for heat treatment according to this invention are found to have an adverse effect on strength if used during forging.

SUMMARY OF THE INVENTION

Figure 1:
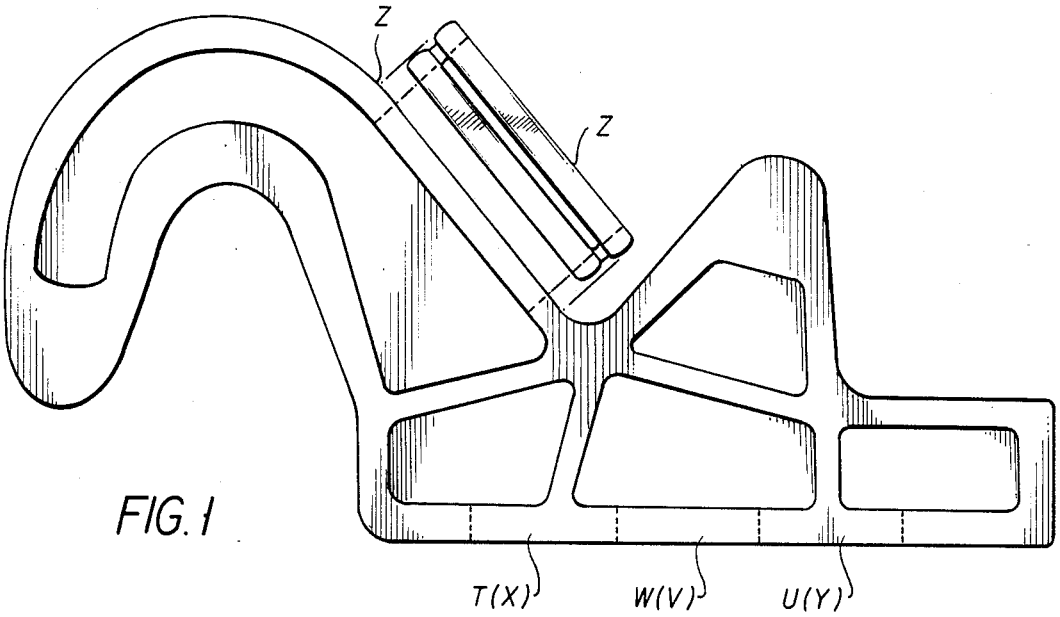
FIG. 1 is a plan drawing of a "Hook"-type forging, showing the location on the Hook of various test specimens.

The present invention is directed to a process for improving the fracture toughness in the non-aged condition with substantially no reduction in tensile properties, of a product composed of an alloy comprising aluminum, lithium and a dispersoid constituent, which comprises: shaping the alloy at a homologous temperature below about 0.75, heat treating the shaped product at or above the temperature of the shaping treatment, provided said heat treating temperature is a homologous temperature in the range of about 0.65 up to about 0.85, and cooling the resultant heat treated shaped product.

The homologous temperature is the heat treating temperature in absolute degrees divided by the liquidus temperature in absolute degrees. Shaping can be accomplished, for example, by rolling, extruding, hammering or swaging. The material to be shaped, in turn, can be formed by an ingot metallurgy route or by compaction of a powder. In general, shaping is done at an elevated temperature, i.e. by a thermomechanical treatment. It is also known to include room temperature treatment in the shaping steps, e.g. subsequent to shaping at elevated temperature. Cooling of the heat treated product can be accomplished by cooling in air or a liquid such as water, e.g. with a hot or cold water quench. Cooling in air is slower, but preferred where avoidance of distortion of the product is important. Cooling is preferably done outside the furnace. Cooling in the furnace is too slow and thus considered uneconomical.

An important aspect of the present invention is that the alloys given the heat treatment of this invention have improved fracture toughness in the non-aged condition without sacrifice to any substantial degree in the tensile strength properties. However, the alloys may be aged subsequently to the present treatment if desired.

As will be further described herein, the heat treatment of this invention is carried out subsequent to forming the alloy into a shaped product. The shaping can be carried out in more than one step. In one advantageous embodiment of this invention the product is forged in a multistep process and the heat treatment is combined with a final finishing step to produce a forged product characterized by high strength and high fracture toughness. For minimizing distortion the heat treatment is carried out at the lower end of the temperature range. However, increase in toughness can be effected even at temperatures at or near solution temperatures of the alloy, so that the ultimate use will be a factor in determining the optimum temperature for a particular material.

The essential components of the alloys of the present invention comprise: aluminum, lithium and a dispersoid constituent. Elements other than aluminum and lithium may be present, e.g. magnesium, copper, and silicon particularly in (but not limited to) amounts for solution strengthening of the alloy. Other elements, e.g. zinc, zirconium, iron and carbon (but not limited thereto) may be incorporated in the alloy so long as they do not interfere with the desired properties of the alloy for the ultimate end use, or they may be picked up as impurities in the feed materials or in preparing the alloy. The dispersoid constituent comprises a component which is or is capable of forming a second phase in the alloy. The second phase may be a strengthening or a grain refining agent, or a combination thereof. The dispersoid constituent may be formed in situ or by addition to the feed material in preparing the alloy or a combination thereof. Many techniques are known in ingot and in powder metallurgy technologies for incorporating dispersoids in Al-base alloys. One technique for forming and/or uniformly distributing a dispersoid in the alloy in a powder metallurgy route is by mechanical alloying. A known technique in ingot metallurgy is to add one or more dispersion forming elements to the melt. Dispersoids may be present in the alloy, for example, in elemental form, as compounds and/or as intermetallics. Examples of elements which may be present as dispersoids are zirconium, iron, zinc, manganese, nickel, titanium, beryllium, boron, calcium, niobium, chromium, vanadium, and rare earth metals, e.g. yttrium, cerium and lanthanum. Examples of compounds are carbides, oxides and/or silicides of the above mentioned elements or combinations thereof. Examples of intermetallics are $FeAl_3$, $NiAl_3$, $TiAl_3$, and $CrAl_7$.

In one advantageous dispersion strengthened alloy system of this invention the alloy system consists essentially, by weight, of about 0.5 up to about 4% lithium, preferably up to about 2¾%, about 0.5 up to about 7% magnesium, a small but effective amount for increased strength, e.g., about 0.05% up to about 5% carbon, a small but effecive amount up to about 2% oxygen, and the balance essentially aluminum, and it has a dispersoid content of a small but effective amount for increased strength up to about 10 volume % dispersoid. Typically, when a dispersoid is present it is present in an amount up to about 7 volume %. In a preferred embodiment the dispersion strengthened alloy is shaped by forging in one or more steps, and in a more preferred embodiment the alloy is prepared from a mechanically alloyed powder. In general the heat treatment for achieving the increased fracture toughness of an alloy in this Al-Mg-Li system will be in the range of about 345° C. (650° F.) to about 510° C. (950° F.).

DETAILED ASPECTS OF INVENTION (A) Composition

As indicated above the essential components of the present alloy system are aluminum, lithium and a dispersoid constituent. However, as indicated above other elements and/or compounds may be present so long as they do not adversely affect the properties of the alloy for the desired end use. In an advantageous embodiment of the invention oxides and carbides are present as dispersion strengthening agents.

Unless otherwise specified, concentration of components is given in weight %.

The lithium level in the alloys may range, for example, from about 0.5 to about 4%, advantageously in an amount of about 1 up to less than 3%, and preferably from about 1.5 or 1.6 up to about 2.7 or 2.8%.

Magnesium may be present. The level of magnesium may be from 0 up to about 7%. Advantageously, magnesium is present and in a range from about 1 up to about 5%, preferably it is about 2 up to about 4 or 4.5%. Exemplary alloys contain above 1.5 up to about 2.5% of lithium and about 2 to about 4.5% magnesium.

Copper may be present. The copper level may range from 0 up to about 6%, e.g. about 1% up to about 5%. If both copper and magnesium are present, in general the total amount of copper and magnesium does not exceed about 6%. Zirconium may be present. The zirconium level may range, for example, from 0 up to about 2%, typically up to about 1% and preferably up to about 0.5%. Cerium may be present. The cerium level may range, for example, from 0 up to about 5%, typically up to about 4%. Zinc may be present, and the zinc level may range, for example, from 0 up to about 6%. Silicon may be present, and the silicon level may be 0 up to about 2%, typically 0.4 to 1%.

Carbon may be present in the system in an amount up to about 5%, advantageously at a level ranging from a small but effective amount for increased strength up to about 5%. Typically the level of carbon may range up to about 2%, advantageously from about 0.05% up to about 1% or 1.5%, and preferably about 0.2 up to about 1.2%. In the embodiment in which the alloy is prepared from a mechanically alloyed powder the carbon is generally provided by a process control agent during the formation of the mechanically alloyed powders. Preferred process control agents are methanol, stearic acid, and graphite. In general the carbon present will form carbides, e.g. with one or more of the components of the system.

Oxygen is usually present in the system, and it is usually desirable to have the level of oxygen very low. In general, oxygen is present in a small but effective amount for increased strength and stability, e.g., about 0.01% up to about 2%, and preferably, it does not exceed about 1%. The low oxygen content is believed to be important. Depending on the system, when the oxygen content is above 2% the alloy systems of this invention may have poor ductility. In alloys containing above 1.5% Li, the oxygen content preferably does not exceed about 1%.

The alloy may additionally contain small amounts, e.g. of nickel, chromium, iron, manganese and other elements. It will be appreciated that the alloys may contain other elements which when present may enhance certain properties and in amounts which do not adversely affect the alloy for a particular end use.

The dispersoid constituent is present in a range of a small but effective amount for increased strength up to about 10 volume % (vol.%) or even higher. Preferably the dispersoid level is as low as possible consistent with desired strength. In alloys having oxides, carbides and/or silicides as dispersoid constituents, typically, the dispersoid level is about 1.5 to 7 vol. %. Preferably it is about 2 to 6 vol.%. The dispersoids may be present, for example, as an oxide of aluminum, lithium, or magnesium or combinations thereof. The dispersoid can be formed during the mechanical alloying step and/or later consolidation and thermomechanical processing. Possibly they may be added as such to the powder charge. Other dispersoids may be added or formed in-situ so long as they are stable in the aluminum alloy matrix at the ultimate temperature of service. Examples of dispersoids that may be present are $Al_2O_3$, AlOOH, $Li_2O$, $Li_2Al_2O_4$, $LiAlO_2$, $LiAl_5O_8$, $Li_3AlO_4$ and MgO. The dispersoids may be carbides, e.g. $Al_4C_3$. As indicated above, intermetallics may be present.

In a preferred alloy system of this invention the lithium content is about 1.5 up to about 2.5%, the magnesium content is about 2 up to about 4%, the carbon content is about 0.5 to about 2%, and the oxygen content is less than about 0.5%, and the dispersoid level is about 2 or 3 to 6 volume %. For example, the alloys may be comprised of: Al-4Mg-1.5Li-1.2C, Al-5Mg-1Li-1.1C, Al-4Mg-1.75Li-1.1C, Al-2Mg-2Li-1.1C, Al-2Mg-2.5Li-1.1C, Al-4Mg-2.5Li-0.7C and Al-2Mg-2.5Li-0.7C.

B. Process

1. Preparation Prior to Shaping

As indicated above the alloys of the present invention may be prepared by ingot or powder metallurgy techniques. There are many processes well known to those skilled in the art. In an advantageous embodiment, the alloy is formed by a powder metallurgy technique, preferably by mechanical alloying. Briefly, in the mechanical alloying route aluminum powder is prepared by subjecting a powder charge to dry, high energy milling in the presence of a grinding media, e.g. balls, and a process control agent, under conditions sufficient to comminute the powder particles to the charge, and through a combination of comminution and welding actions caused repeatedly by the milling, to create new, dense composite particles containing fragments of the initial powder materials intimately associated and uniformly interdispersed. Milling is done in a protective atmosphere, e.g. under an argon or nitrogen blanket, thereby facilitating oxygen control since virtually the only sources of oxygen are the starting powders and the process control agent. The process control agent is weld-controlling, and may be a carbon-contributing agent and may be, for example, graphite or a volatilizable oxygen-containing hydrocarbon such as organic acids, alcohols, heptanes, aldehydes and ethers. The formation of dispersion strengthened mechanically alloyed aluminum is given in detail in U.S. Pat. Nos. 3,740,210 and 3,816,080, mentioned above. Suitably the powder is prepared in an attritor using a ball-to-powder weight ratio of 15:1 to 60:1. As indicated above, preferably process control agents are methanol, stearic acid, and graphite. Carbon from these organic compounds and/or graphite is incorporated in the powder and contributes to the dispersoid content.

Before the dispersion strengthened mechanically alloyed powder is consolidated it must be degassed and compacted. Degassing and compacting are effected under vacuum and generally carried out at a temperature in the range of about 480° C. (895° F.) up to just below incipient melting of the alloy. As indicated above, the degassing temperature should be higher than any subsequently experienced by the alloy. Degassing is preferably carried out, for example, at a temperature in the range of from about 480° C. (900° F.) up to 545° C. (1015° F.) and more preferably above 500° C. (930° F.). Pressing is carried out at a temperature in the range of about 545° C. (1015° F.) to about 480° C. (895° F.).

In a preferred embodiment the degassing and compaction are carried out by vacuum hot pressing (VHP). However, other techniques may be used. For example, the degassed powder may be upset under vacuum in an extrusion press. To enable the powder to be extruded to substantially full density, compaction should be such that the porosity is isolated, thereby avoiding internal contamination of the billet by the extrusion lubricant. This is achieved by carrying out compaction to at least 85% of full density, advantageously above 95% density, and preferably the material is compacted to over 99% of full density. Preferably the powders are compacted to 99% of full density and higher, that is, to substantially full density.

The resultant compaction products formed in the degassing and compaction step or steps are then consolidated.

2. Shaping

Shaping of the material is carried out by a mechanical treatment in one or more steps which may be, for example, extruding, forging, rolling, hammering, stamping, swaging, upsetting, coining, etc., or combination thereof. The preliminary shaping treatment may include a step for consolidation of compaction in a powder metallurgy route. In a preferred embodiment of this invention consolidation is carried out by extrusion in a conical-type die, using a lubricant and under a controlled elevated temperature.

In general, shaping is carried out as a thermomechanical process at a homologous temperature below 0.75. However, shaping may be done at ambient temperature in one of the shaping steps.

As indicated, the shaping may include more than one step and may be a combination of treatments, e.g. extrusion and forging. An advantageous method of extruding and forging an Al-Li-Mg alloy is disclosed in the aforementioned U.S. patent application. Typically extrusion for an Al-Li-Mg alloy is in the range of about 230° C. (450° F.) and about 400° C. (750° F.). Advantageously, it should be carried out below about 370° C. (700° F.) and should not exceed about 345° C. (650° F.). Preferably it should be lower than about 330° C. (625° F.). The temperature should be high enough so that the alloy can be pushed through the die at a reasonable pressure. Typically this will be above about 230° C. (450° F.). It has been found that a temperature of about 260° C. (500° F.) for extrusion is highly advantageous. By carrying out the extrusion at about 260° C. (500° F.), there is the added advantage of greater flexibility in conditions which may be used during the forging operation. This flexibility decreases at the higher end of the extrusion temperature range.

In the event the shaping includes one or more forging steps, in general, forged aluminum alloys of the present invention will benefit from forging temperatures being as low as possible consistent with the alloy composition and equipment. Forging may be carried out as a single or multi-step operation. In multi-step forging the temperature control applies to the initial forging or blocking-type step. As in the extrusion step, it is believed that for high strength the aluminum alloys of this invention should be forged at a temperature below one where a decrease in strength will occur. In the Al-Mg-Li alloys systems forging should be carried out at a homologous temperature below 0.75. For example, about 400° C. (750° F.), and preferably less than 370° C. (700° F.), e.g. in the range of 230° C. (450° F.) to about 345° C. (650° F.), typically about 260° C. (500° F.). Despite the fact that forgeability may increase with temperature, the higher forging temperatures are found to have an adverse effect on strength.

3. Treatment Subsequent to Shaping

Subsequent to shaping by a mechanical treatment into a product form, the shaped product is subjected to a controlled heat treatment followed by cooling. The heat treatment of the shaped product is carried out at a temperature above the temperature of the mechanical treatment and in the homologous temperature range of about 0.65 to about 0.85.

For example, where the liquidus temperature of the alloy is about 637° C. (1180° F. or 911° K.) the mechanical treatment is below about 400° C. (750° F.), then the heat treatment is carried out typically above about 400° C. (750° F.) to about 510° C. (950° F.), e.g. about 425° C. (800° F.) or about 455° C. (850° F.) up to about 480° C. (900° F.).

The shaped product need only be held at temperature sufficiently long for the entire shaped product to come to a temperature within the desired range. Advantageously, the entire shaped product is raised to the same temperature within the desired range, but this is not necessary. If the shaped product is not held at temperature sufficiently long for the entire shaped product to react to a temperature within the desired range, there is the danger of non-uniformity in properties of the resultant shaped product. It is advantageous from the point of cost to hold the shaped product at temperature for the shortest period of time to achieve the desired properties. However, it will not be harmful insofar as properties are concerned to hold the shaped product at temperature for a longer period of time. If heating is carried out at a homologous temperature below about 0.65 then either the improvement in fracture toughness will not be attained or the period of time to obtain it will be excessive, and above about 0.85 the tensile properties and fracture toughness will be adversely affected.

Although found that it was the initial steps of the shaping in which the low temperature control is critical, it was surprising to find that fracture toughness could be improved by a controlled heat treatment after thermomechanical steps for shaping.

The heat treatment may advantageously include a finishing step for the product form.

4. Cooling

As explained above, cooling of the material is important since too rapid cooling may lead to distortion of the material. Cooling is preferably outside the furnace, because furnace cooling is too slow and economically disadvantageous. Additionally, very slow cooling may lead to the formation of inhomogeneity.

5. Age Hardening

A heat treatment may be carried out, if desired, on alloy systems susceptible to age hardening. In alloys having age hardenable components additional strength may be gained, but this may be with the loss of other properties, e.g. corrosion resistance. It is a particular advantage of the present invention that low density aluminum alloys can be made with high strength, e.g. over 410 MPa (60 ksi) in the forged condition without having to resort to age hardening treatments which might result in alloys which have less attractive properties other than strength. In some alloy systems of this invention, however, it is necessary to age harden the material to obtain desired tensile properties.

It is noted that in conversion from °F. to °C., the temperatures were rounded off, as were the conversion from ksi to MPa and inches to centimeters. Also alloy compositions are nominal. With respect to conditions, for commercial production it is not practical or realistic to impose or require conditions to the extent possible in a research laboratory facility. Temperatures may stray, for example, 50° F. of the target. Thus, having a wider window for processing conditions adds to the practical value of the process.

This invention is further described in, but not limited by, the examples given below. In all the examples the test samples illustrating this invention were prepared from dispersion strengthened alloy powder comprising aluminum, magnesium, lithium, carbon and oxygen, prepared by a mechanical alloying technique, and having the nominal composition Al-4Mg-1.5Li-1.2C.

EXAMPLE 1

The example illustrates the effect of incorporating the treatment of this invention in the fabrication of forged samples prepared from mechanically alloyed, dispersion strengthened Al-4Mg-1.5Li-1.2C.

For the tests "Hook"-type forgings are prepared from 28 cm (11") diameter vacuum hot pressed billet extruded to 9.8 cm (3.875") diameter at approximately 260° C. (500° F.) and 0.76 cm/sec (18 in/min) ram speed. The forgings are prepared at approximately 270° C. (522° F.) in the 1st blocker, 230° C. (450° F.) in the 2nd blocker and 320° C. (612° F.) in the final forging step. Subsequent to the final forging step, samples are subjected to various heat treatments and cooling profiles.

FIG. 1 shows a plan drawing of the finished "Hook"-type forging with test sections labeled. Specimens for the test of this example are taken from section Z (shown in two dimensions in FIG. 1) and are 1.3 cm (0.5") size, specimen breadth. The longitudinal (L) direction is taken along the hook, long transverse (LT) from front to back of the hook and short transverse (ST) from top to bottom of the hook.

For fracture toughness a "Short Bar Test" is used which is described in a report in an ASTM Symposium on Chevron-Notched specimens given in Louisville, Ky.; Apr. 12, 1983. Tests were carried out at an independent laboratory.

The tests are carried out on materials "as-forged" and on those given various heat and cooling treatments. Conditions for treatment and results are given in TABLE I.

TABLE I

Fracture Toughness of Short Bar Specimen Forging

| Sample | Treatment: Heat °C. | Heat (°F.) | Hr | Cooling | Orientation | Fracture Toughness MPa m$^{\frac{1}{2}}$ | (Ksi in$^{\frac{1}{2}}$) |
|---|---|---|---|---|---|---|---|
| 1 | 480 | (900) | 3 | HWQ | L-LT | 31.5 | (28.7) |
| 2 | 480 | (900) | 3 | AC | L-LT | 25.1 | (22.9) |
| *3 | 455 | (850) | 3 | AC | L-LT | 27.0 | (24.6) |
| *4 | 455 | (850) | 3 | AC | L-LT | 28.0 | (25.5) |
| 5 | | F | | | L-LT | 21.2 | (19.3) |
| 6 | | F | | | ST-LT | 23.6 | (21.5) |
| 7 | 455 | (850) | 3 | AC | ST-LT | 26.7 | (24.3) |
| 8 | 480 | (900) | 3 | AC | ST-LT | 25.6 | (23.3) |
| 9 | 480 | (900) | 3 | HWQ | ST-LT | 31.8 | (29.0) |
| 10 | 400 | (750) | 3 | AC | L-LT | 25.0 | (22.8) |
| 11 | 425 | (800) | 3 | AC | L-LT | 26.4 | (24.0) |
| 12 | 400 | (750) | 24 | AC | L-LT | 26.0 | (23.7) |
| 13 | 400 | (750) | 3 | HWQ | L-LT | 32.1 | (29.2) |
| 14 | 455 | (850) | 3 | HWQ | L-LT | 32.5 | (29.6) |
| 15 | 480 | (900) | 3 | HWQ | L-LT | 31.7 | (28.9) |

*Different Locations
L = Longitudinal
LT = Long Transverse
ST = Short Transverse
WQ = Water Quench at Room Temperature
AC = Air Cool
F = As-Forged
HWQ = Hot Water Quench at 65° C. (150° F.)

The results show the increased fracture toughness of the specimens treated in accordance with the present invention over the "as-forged" untreated specimens. The lower temperature heat treatment is preferred because it gives the least amount of shape distortion. All results were reported by an independent laboratory as valid, i.e. all specimens exhibited good in-plane cracking.

EXAMPLE 2

This example illustrates the effect of the treatment of the present invention on tensile properties in the longitudinal direction of extruded and of forged samples of Al-4Mg-1.5Li-1.2C.

Part A - Forged Samples

Figure 2:
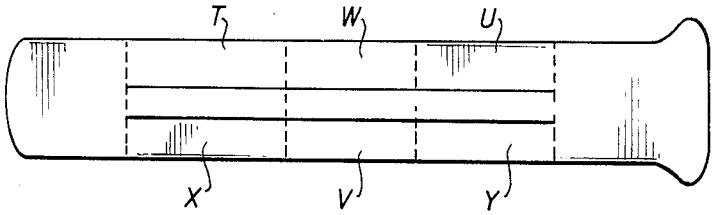
FIG. 2 is a view across the bottom of FIG. 1, showing the location of various test specimens.

Tensile properties of the Hook forging of Example 1 are obtained on samples taken from locations designated on FIG. 2. Conditions for treatment and results are given in TABLE II.

TABLE II

| Treatment | | | | Specimen | YS 0.2% Offset | | UTS | | | |
|---|---|---|---|---|---|---|---|---|---|---|
| Heat | | | | | | | | | | |
| °C. | (°F.) | Hrs | Cooling | Location | MPa | (ksi) | MPa | (ksi) | El. (%) | RA (%) |
| As-Forged | | | | * | 450 | (65.3) | 525 | (76.1) | 9 | 15.2 |
| 455 | (850) | 3 | HWQ | Y | 474 | (68.7) | 530 | (76.8) | 10 | 19 |
| | | | | X | 461 | (66.9) | 523 | (75.8) | 10 | 13.3 |
| | | | | W | 467 | (67.7) | 522 | (75.7) | 8 | 9.5 |
| 455 | (850) | 3 | AC | V | 481 | (69.7) | 537 | (77.8) | 7 | 8.6 |
| | | | | U | 475 | (68.9) | 517 | (74.9) | 7 | 13.3 |
| | | | | T | 446 | (64.7) | 501 | (72.7) | 9 | 18.5 |

*On prolongation end (not shown)

Part B - Extruded Samples

Tensile properties of extruded material formed from mechanically alloyed powder are obtained on samples extruded at 260° C. (500° F.) from 28 cm (11") diameter to 9.8 cm (3.875") diameter at 0.4 cm/sec (10 in/min), and then re-extruded at 370° C. (700° F.) from 8.9 cm (3.5") diameter to 5 cm (2")×1.9 cm (0.75"). Conditions and results are shown in TABLE III.

TABLE III

| Treatment | | | | YS 0.2% Offset | | UTS | | | |
|---|---|---|---|---|---|---|---|---|---|
| Heat | | | | | | | | | |
| °C. | (°F.) | Hrs | Cooling | MPa | (ksi) | MPa | (ksi) | El. (%) | RA (%) |
| As-Extruded | | | | 564 | (81.8) | 594 | (86.1) | 3 | 12.5 |
| 455 | (850) | 2 | WQ | 564 | (81.8) | 574 | (83.3) | 6 | 17.5 |
| 455 | (850) | 2 | AC | 578 | (83.8) | 578 | (86.0) | 5 | 17.6 |
| 480 | (900) | 2 | WQ | 552 | (80) | 559 | (81) | 6 | 15.4 |

The results show that there is essentially no change in tensile properties resulting from the treatment of this invention.

It is noteworthy that Al-Li alloys could be produced which have a yield strength of over about 414 MPa (60 Ksi) and a fracture toughness of over about 22 MPa $m^{\frac{1}{2}}$ (20 Ksi $in^{\frac{1}{2}}$).

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A process for improving the fracture toughness in the non-aged condition with substantially no reduction in tensile properties, of a product composed of an alloy containing, by weight, about 0.5 to about 4% lithium, 0 up to about 7% magnesium, 0 up to about 6% copper, 0 up to about 2% zirconium, 0 up to about 5% cerium, 0 up to about 6% zinc, 0 up to about 2% silicon, 0 up to about 5% carbon, 0 up to about 2% oxygen, and the balance essentially aluminum, and wherein the alloy product further contains 0 up to about 10% by volume of a dispersoid, which comprises: shaping the alloy at a homologous temperature of said alloy below about 0.75, heat treating the shaped product above the temperature of the shaping treatment, provided said heat treating temperature is a homologous temperature in the range of about 0.65 up to about 0.85, and cooling the resultant heat treated shaped product.

2. A process according to claim 1, wherein shaping is accomplished by rolling.

3. A process according to claim 1, wherein cooling is accomplished outside the furnace and by a method selected from the group air cooling and liquid quenching.

4. A process according to claim 1, wherein the product is formed by a powder metallurgy route.

5. A process according to claim 1, wherein the product is formed by an ingot metallurgy route.

6. A process according to claim 1, wherein the shaping is accomplished by forging.

7. A process according to claim 4, wherein the shaping is accomplished by forging.

8. A process according to claim 3, wherein the cooling is accomplished by air cooling.

9. A process according to claim 1, wherein subsequent to cooling the product is aged.

10. A process for improving the fracture toughness in the non-aged condition, without sacrificing substantially tensile properties, of a product made from an aluminum-lithium alloy powder comprising, by weight, 0 to about 4% lithium, 0 to about 7% magnesium, 0 to about 2% oxygen, 0 to about 5% carbon and the balance essentially aluminum, which comprises: degassing and compacting the powder at temperature in the range of about 480° C. up to the incipient melting temperature of the alloy, consolidating the compaction and then shaping the consolidated material by a thermomechanical treatment at a homologous temperature of said alloy below 0.75, subjecting the resultant shaped product to a homologous temperature above the temperature above the temperature of the thermomechanical treatment, provided said heat treating temperature is a homologous temperature in the range of 0.65 to 0.85, and cooling the resultant heat treated shaped product.

11. A process according to claim 10, wherein shaping is effected by steps comprising forging.

12. A process according to claim 11, wherein the alloy contains up to 2¾% lithium.

13. A process according to claim 11, wherein the alloy consists essentially of about 1 to 2¾% lithium, about 2 to about 4.5% magnesium, a small but effective amount for increased strength up to about 2% carbon, a small but effective amount for increased strength and temperature stability up to about 2% oxygen.

14. An aluminum-base alloy product produced by the method of claim 1.

15. A dispersion strengthened aluminum-lithium-magnesium alloy produced by the method of claim 11.

16. A dispersion strengthened aluminum-lithium-magnesium alloy consisting essentially of about 1 to about 3% lithium, about 1 to about 5% magnesium, a small but effective amount for increased strength up to about 2% carbon, a small but effective amount for increased strength up to about 2% oxygen, said alloy having in the forged heat-treated, non-aged condition a Y.S. (0.2% offset) of at least 414 MPa (60 Ksi), and a fracture toughness of at least about 22 MPa $m^{\frac{1}{2}}$ (20 Ksi $in^{\frac{1}{2}}$).

17. A dispersion strengthened alloy according to claim 16, wherein the alloy is comprised of about 1 up to about 2¾% lithium and about 2 to about 4% magnesium.

18. A dispersion strengthened alloy according to claim 16, wherein the alloy is comprised of about 1.5% lithium and about 4% magnesium.

19. A process according to claim 5, wherein the shaping is accomplished by forging.

20. A shaped article composed of a dispersion strengthened aluminum-lithium-magnesium alloy consisting essentially of about 1 to about 3% lithium, about 1 to about 5% magnesium, a small but effective amount for increased strength up to about 2% carbon, a small but effective amount for increased strength up to about 2% oxygen, said alloy having in the forged, heat-treated, non-aged condition a Y.S. (0.2% offset) of at least 414 MPa (60 Ksi), and a fracture toughness of at least about 22 MPa $m^{\frac{1}{2}}$ (20 Ksi $in^{\frac{1}{2}}$).

21. A process according to claim 1 wherein the shaping treatment is accomplished by extruding.

22. A process according to claim 1 wherein the shaping treatment is accomplished by hammering.

23. A process according to claim 1 wherein the shaping treatment is accomplished by swaging.

24. A process according to claim 1 wherein the shaping treatment is accomplished by coining.

25. A process according to claim 1 wherein the shaping treatment is accomplished by upsetting.

* * * * *